US006004410A

United States Patent [19]

Blomquist

[11] Patent Number: 6,004,410

[45] Date of Patent: Dec. 21, 1999

[54] APPARATUS COMPRISING AN INFLATABLE VEHICLE OCCUPANT PROTECTION DEVICE AND A GAS GENERATING COMPOSITION THEREFOR

[75] Inventor: Harold R. Blomquist, Gilbert, Ariz.

[73] Assignee: TRW Inc., Lyndhurst, Ohio

[21] Appl. No.: 09/123,821

[22] Filed: Jul. 28, 1998

[51] Int. Cl.[6] ..... C06B 31/00; C06B 45/10

[52] U.S. Cl. ..... 149/45; 149/19.6; 149/19.1

[58] Field of Search ..... 149/45, 46, 19.6, 149/19.1

[56] References Cited

U.S. PATENT DOCUMENTS

| | | | |
|---|---|---|---|
| 5,292,387 | 3/1994 | Highsmith et al. | 149/19.1 |
| 5,324,075 | 6/1994 | Sampson | 280/736 |
| 5,498,303 | 3/1996 | Hinshaw et al. | 149/19.6 |
| 5,741,998 | 4/1998 | Hinshaw et al. | 149/19.6 |
| 5,780,769 | 7/1998 | Russell et al. | 149/45 |
| 5,868,424 | 2/1999 | Hamilton et al. | 280/741 |
| 5,889,161 | 3/1999 | Bottaro et al. | 534/551 |

*Primary Examiner*—Charles T. Jordan
*Assistant Examiner*—Aileen J. Baker
*Attorney, Agent, or Firm*—Tarolli, Sundheim, Covell, Tummino & Szabo LLP

[57] ABSTRACT

An apparatus comprises an inflatable vehicle occupant protection device and a gas generating composition. The gas generating composition comprises an oxidizer, a fuel component and preferably a binder. A preferred oxidizer is ammonium nitrate. The fuel component is a dinitramide salt having the molecular formula $X^+[N(NO_2)_2]_n^-$ wherein n is equal to one or more and $X^+$ is the cationic derivative of an organic compound having one or more tetravalent nitrogen atoms. A preferred salt is guanidinium dinitramide.

17 Claims, 2 Drawing Sheets

APPARATUS COMPRISING AN INFLATABLE VEHICLE OCCUPANT PROTECTION DEVICE AND A GAS GENERATING COMPOSITION THEREFOR

FIELD OF THE INVENTION

The present invention relates to an apparatus comprising an inflatable vehicle occupant protection device and a gas generating composition for providing inflation gas for inflating the inflatable vehicle occupant protection device.

BACKGROUND OF THE INVENTION

An inflator for inflating an inflatable vehicle occupant protection device, such as an air bag, contains a body of ignitable gas generating material. The inflator further includes an igniter. The igniter is actuated so as to ignite the body of gas generating material when the vehicle experiences a collision for which inflation of the air bag is desired. As the body of gas generating material burns, it generates a volume of inflation gas. The inflation gas is directed into the vehicle air bag to inflate the air bag. When the air bag is inflated, it expands into the vehicle occupant compartment and helps to protect the vehicle occupant.

It is desirable that the gas generating material used for providing inflation gas for inflating an inflatable vehicle occupant protection device meet a number of technical requirements such as:

1. The burn rate of the gas generating material must be fast enough to inflate the inflatable vehicle occupant protection device to protect the vehicle occupant.

2. The gas generating material must be chemically and mechanically stable over a wide range of temperatures to be suitable for use in a vehicle.

3. The gas generated by combustion of the gas generating material should be substantially free of toxic materials.

4. The gas generated should be essentially smoke-free.

Solid gas generating compositions based on a non-azide organic fuel component and ammonium nitrate as an oxidizer potentially offer a way to achieve a smoke-free gas that is substantially free of toxic materials. However, many such compositions containing ammonium nitrate as the oxidizer have relatively low burn rates as well as reduced physical integrity when subjected to thermal cycling.

The unfavorable characteristics of ammonium nitrate based compositions can be reduced by selecting organic fuels which contain oxygen atoms. Organic fuels which contain oxygen atoms reduce the amount of the ammonium nitrate that is needed for substantially stoichiometric or complete combustion of the fuel. For example, a fuel like dicyandiamide, which contains no oxygen atoms, may require 85% ammonium nitrate for complete combustion. Nitroguanidine, which contains oxygen atoms, may require only 60% ammonium nitrate for complete combustion. Many fuels containing oxygen atoms, however, are high energy and may be too energetic, or too chemically unstable, for use in a vehicle.

U.S. Pat. No. 5,498,303 discloses the use of a dinitramide salt in a rocket motor propellant. The salt is used as an oxidizer in the propellant to replace ammonium nitrate. The patent mentions ammonium nitrate's poor performance capability, its inability to combust aluminum fuel efficiently, and its low burn rate. Ammonium dinitramide is listed as a preferred oxidizer. However, other dinitramide salts such as tetrazolium dinitramide are also disclosed as substitutes for ammonium nitrate. There is no suggestion in the patent of using a dinitramide salt as a fuel component in a composition having ammonium nitrate as the oxidizer. Moreover, ammonium dinitramide, the preferred dinitramide salt in the patent, in addition to being an oxidizer, is not thermally stable enough for use in a vehicle.

SUMMARY OF THE INVENTION

The present invention resides in an apparatus comprising an inflatable vehicle occupant protection device and a gas generating composition for providing inflation gas for inflating the inflatable vehicle occupant protection device. The gas generating composition comprises an oxidizer, a fuel component, and preferably a binder. A preferred oxidizer is ammonium nitrate. The fuel component is a dinitramide salt. The molecular formula of the dinitramide salt is $X^+[N(NO_2)_2]_n^-$, wherein n is one or more and $X^+$ is a cationic derivative of an organic compound having one or more tetravalent nitrogen atoms.

In a preferred embodiment of the present invention, the oxidizer is phase stabilized ammonium nitrate and the fuel component is guanidinium dinitramide.

DESCRIPTION OF THE DRAWING

The present invention and advantages of the invention will become more apparent from the following description with reference to the accompanying drawings, in which.

DESCRIPTION OF PREFERRED EMBODIMENTS

Figure 1:
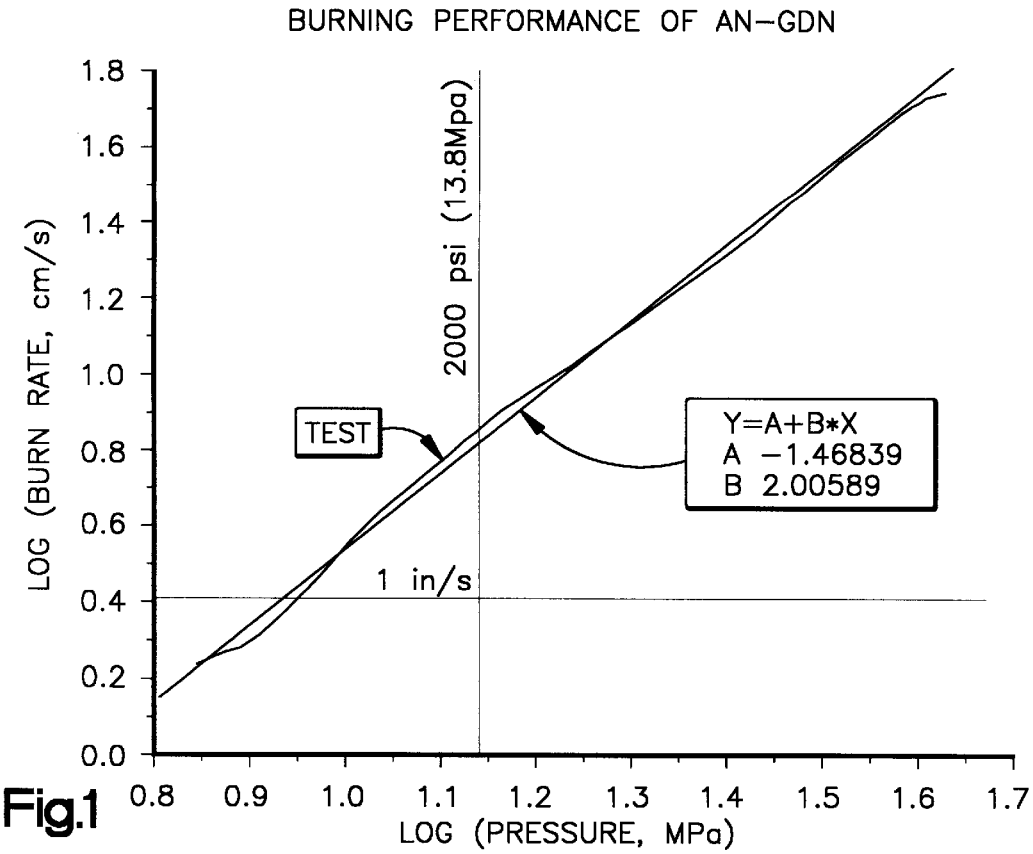
FIG. 1 is a computer generated graph of the burn rate plotted against pressure resulting from the combustion of a body of gas generating material in accordance with one embodiment of the present invention comprising ammonium nitrate (AN) and guanidinium dinitramide (GDN)

The gas generating composition of the present invention is for inflating a vehicle occupant protection device such as an air bag, an inflatable seat belt, an inflatable knee bolster, an inflatable air bag to operate a knee bolster, an inflatable head liner, and/or an inflatable side curtain. An igniter, which is actuated when the vehicle experiences a condition, such as a collision, for which inflation of the inflatable device is desired, ignites the gas generating composition. As the gas generating composition burns, it generates a volume of inflation gas. The inflation gas is directed into the inflatable vehicle occupant protection device to inflate the device. When the device is inflated, it expands, for example into the vehicle occupant compartment, and helps to protect the vehicle occupant.

The gas generating composition of the present invention comprises a fuel component. The fuel component is a dinitramide salt having the formula $X^+[N(NO_2)_2]_n^-$, wherein n is one or more and $X^+$ is a cationic derivative of an organic compound having one or more tetravalent nitrogen atoms.

The organic cation of the dinitramide salt is selected on the basis of a number of criteria, such as:

1. The organic compound provides a dinitramide salt having a high melting point suitable for use in vehicle occupant protection device, preferably a melting point of at least 125° C.

2. The dinitramide salt when combined with the oxidizer and burned has a high burn rate, at least 0.2 inch/sec (0.508 cm/sec) at 2000 psi (13.8 Mpa).

3. The dinitramide salt when combined with the oxidizer and burned has a controlled increase in the burn rate with an increase in pressure which follows the relationship $R=aP^n$ wherein n, the burn rate exponent, is preferably about 2 or less.

4. The cation contains an amount of oxygen atoms effective to reduce the amount of oxidizer needed for combustion of the fuel component to a gas product consisting essentially of carbon dioxide, nitrogen, and water. Preferably, the amount of oxidizer required is less than about 80% based on the combined weight of the fuel component and oxidizer in the gas generating composition.

5. The dinitramide salt when combined with ammonium nitrate resists metathesis reactions.

In a preferred embodiment, the organic cation forms a dinitramide salt which (a) burns completely when the amount of oxidizer is less than about 60% based on the combined weight of the fuel component and oxidizer, preferably when the amount of oxidizer is in the range of about 10% to about 60% based on the combined weight of the fuel component and the oxidizer, and (b) has a burn rate of at least about 0.6 inch/sec (1.52 cm/sec) at 2000 psi (13.8 MPa) when combined with the oxidizer.

A preferred organic compound useful in forming the dinitramide salt in the present invention is guanidine in which the radical $X^+$ (cation) is guanidinium. The fuel component is guanidinium dinitramide. Other organic compounds useful in the present invention in forming the dinitramide salt include: biguanidine in which the radical $X^+$ is biguanidinium; ethylenediamine in which the radical $X^+$ is ethylenediaminium; piperazine in which the radical $X^+$ is piperazinediium; tetramethylammonia in which the radical $X^+$ is tetramethylammonium; monoaminoguanidine in which the radical $X^+$ is monoaminoguanidinium; diaminoguanidine in which the radical $X^+$ is diaminoguanidinium; triaminoguanidine in which the radical $X^+$ is triaminoguanidinium; tetrazole in which the radical $X^+$ is tetrazolium; aminotetrazole in which the radical $X^+$ is aminotetrazolium; diamino-furazan in which the radical $X^+$ is amino-ammonium-furazan; polyvinylammonia in which the radical $X^+$ is polyvinylammonium (having about 20% conversion of the amine to the dinitramide salt); and dicyandiamide in which the radical $X^+$ bis dicyandiamidium.

The amount of fuel component in the gas generating composition is that amount necessary to achieve sustained combustion of the gas generating composition. This amount can vary depending upon the particular fuel involved and other reactants. A preferred amount of fuel component is that amount necessary to achieve an oxygen balance with the oxidizer which, upon combustion, produces essentially carbon dioxide, nitrogen, and water. Preferably the amount of fuel component is in the range of about 40% to about 90% based on the combined weight of the fuel component and oxidizer.

The oxidizer in the gas generating composition of the present invention can be any oxygen releasing substance. A preferred oxidizer is ammonium nitrate. Other oxidizers that can be used are potassium nitrate, potassium perchlorate, ammonium perchlorate, metal oxides, metal complexes and mixtures of the above. Preferably, the amount of oxidizer is in the range of about 60% to about 10% based on the combined weight of fuel component and oxidizer.

When ammonium nitrate is used as the oxidizer, the ammonium nitrate is preferably phase stabilized. The phase stabilization of ammonium nitrate is well known. In one method, the ammonium nitrate is doped with a metal cation in an amount which is effective to minimize the volumetric and structural changes associated with the Phase IV⇆Phase III transition inherent to pure ammonium nitrate. A preferred phase stabilizer is potassium nitrate. Other useful phase stabilizers include potassium salts such as potassium dichromate, potassium oxalate, and mixtures thereof. Ammonium nitrate can also be stabilized by doping with copper and zinc ions. Other compounds, modifiers, and methods that are effective to phase stabilize ammonium nitrate are well known and suitable in the present invention.

The gas generating composition of the present invention can also comprise an elastomeric binder. Suitable binders for gas generating compositions are well known in the art. Preferred binders include polycarbonates, polyurethanes, polyesters, polyethers, polysuccinates, thermoplastic rubbers, polybutadiene, polystyrene and mixtures thereof.

A preferred amount of binder is in the range of 0 to about 10%, preferably about 2.5% to about 10% based on the weight of the gas generating composition. Since the binder is a fuel, the ratio of dinitramide to oxidizer is adjusted to maintain the desired performance and exhaust product mixture.

The present invention can comprise other ingredients commonly added to a gas generating composition for providing inflation gas for inflating an inflatable vehicle occupant protection device, such as plasticizers, process aids, burn rate modifiers, coolants, and ignition aids, all in relatively small amounts.

EXAMPLE 1

A gas generating composition was prepared comprising guanidinium dinitramide (GDN) and reagent grade ammonium nitrate (AN) in the weight ratio of about 2:1 (about 33 weight percent ammonium nitrate). Prior to mixing, the powders were passed through a 50 mesh screen. The ratio of 2:1 was selected for substantially complete combustion of the guanidinium dinitramide to a gas consisting essentially of carbon dioxide, nitrogen, and water.

Guanidinium dinitramide (GDN) can be represented by the chemical formula $(CNHNH_2NH_3)^+(N(NO_2)_2)^-$. It has a melting point of about 140±5° C. and is chemically stable. Its sensitivity to stimuli such as impact and friction were determined to be 96.6±6 kg-cm and more than 36 kpons, kpons, respectively. Both values meet criteria for a component of a vehicle gas generating composition.

The powder mixture was tested for sensitivity to impact and friction stimuli and was found to be insensitive, measuring beyond the limit of laboratory instrumentation at more than 300 kg-cm impact and 36 kpons friction, respectively, again meeting criteria for a component of a vehicle gas generating composition. Thermal analysis by Differential Scanning Calorimetry (DSC) revealed that the composition had a broad exotherm at 175° C. indicating that the composition melted and decomposed into a gas at a steady rate.

The ammonium nitrate and guanidinium dinitramide mixture was compacted under a compaction pressure of 11,000 ft-lb (1521 kg-m) into tablets having a diameter of approximately 1.3 cm, a thickness of 0.73 cm, and a density of 1.5 $g/cm^3$.

Burning rate samples of the ammonium nitrate and guanidinium dinitramide tablets were tested in a closed bomb having a volume of 64.6 ml. The burning rate increase with pressure was derived from the pressure-time record of the closed bomb test, and is plotted as the wavy line in FIG. 1 in log(burning rate, cm/s) against log(pressure, MPa). The results were fit to a straight line in FIG. 1 by a computer generated program. The mathematical equation for the straight line is log(burning rate, cm/s)=A+B×log(Pressure, MPa). Using this equation, the values of A and B were determined to be +1.468 and 2.006 respectively. Factor B represents the sensitivity of the burning rate to pressure (i.e. burn rate exponent). A burn rate exponent of about 2 or less is desirable for a vehicle gas generating composition.

At 2000 psi (13.8 MPa) the burning rate was found to be 2.59 in/s (6.57 cm/s), which is good for inflating a vehicle occupant protection device.

The close fit of the burn rate results in relation to the calculated straight line indicates that the combustion was stable and free of misfires or irregularities.

The following Table 1 gives additional computer generated data obtained relative to the combustion of the guanidinium dinitramide with ammonium nitrate.

TABLE 1

| | |
|---|---|
| Flame temperature, K | 2884 |
| Exhaust temperature, K | 1280 |
| Gas, moles/100 grams | 4.06 |
| Residue, grams/100 grams (est) | 0 |
| Impetus, lb-ft/lbm | 402,209 |

The combustion produces a smokeless gas. Flame and exhaust temperatures meet criteria for a vehicle gas generating composition. The amount of gas produced in the combustion reaction, and its energy (impetus), are effective for activating a vehicle occupant protection device such as an air bag.

Comparative Example

A gas generating composition was prepared comprising nitroguanidine (NQ) and reagent grade ammonium nitrate (AN), in the weight ratio of about 6:4. This ratio was selected for substantially complete combustion of the fuel component to a gas consisting essentially of carbon dioxide, nitrogen, and water. The chemical formula for nitroguanidine is $NO_2NHCNHNH_2$. The nitroguanidine and ammonium nitrate were prepared separately as powders, screened, mixed, tested as a powder mix, compacted into tablets, and further tested as in Example 1. The test results and other data are given in FIG. 2 and in the following Table 2. In Table 2, results and data from Example 1 are repeated for purposes of comparison.

TABLE 2

| Fuel | GDN | NQ |
|---|---|---|
| Fuel wt % | 67.5 | 60 |
| Ammonium Nitrate wt % | 32.5 | 40 |
| Impact, kg-cm, fuel | >96.6 | >300 |
| Friction, kPons, fuel | >36 | >36 |
| Impact, kg-cm, composition | >300 | >300 |
| Friction, kPons, composition | >36 | >36 |
| Burning rate, | 6.57 | 0.677 |

TABLE 2-continued

| Fuel | GDN | NQ |
|---|---|---|
| cm/sec at 2000 psi (13.8 Mpa) | | (0.266 in/sec) |
| Value of A | +1.468 | −1.454 |
| Value of B | 2.006 | 1.127 |

Figure 2:
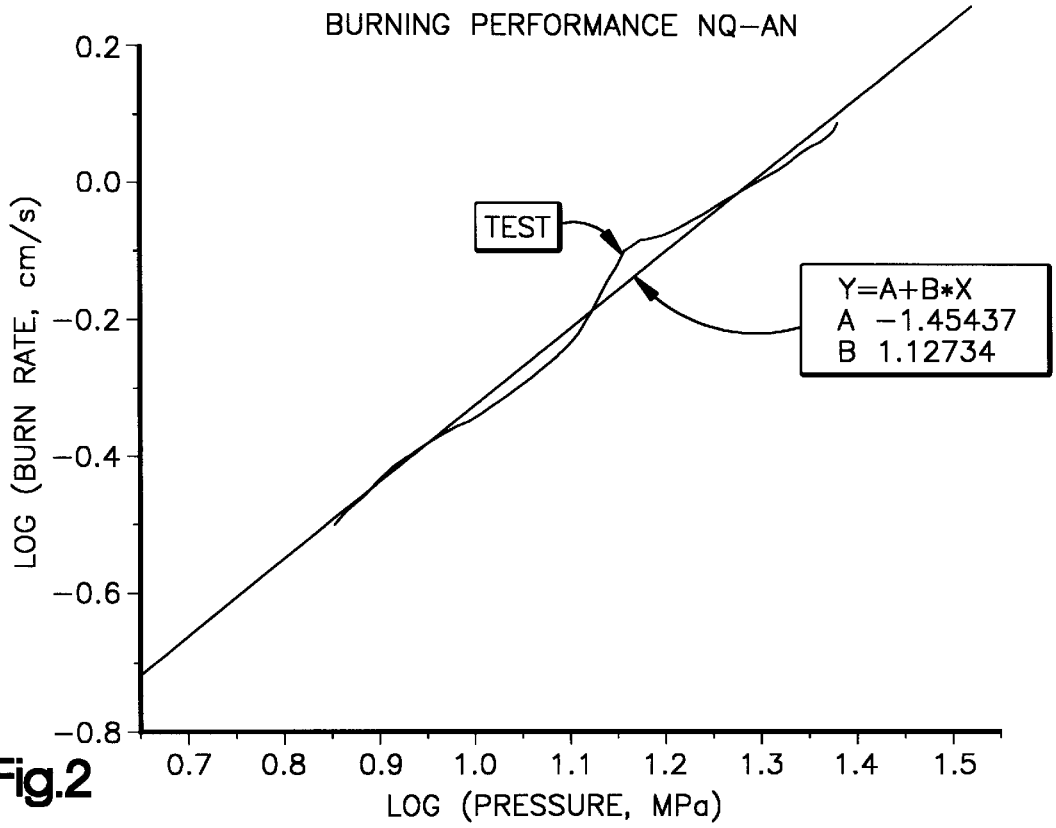
FIG. 2 is a computer generated graph of the burn rate plotted against pressure resulting from the combustion of a control body of gas generating material comprising ammonium nitrate (AN) and nitroguanidine (NQ)

The values of A and B for Comparative Example 1 were calculated from the data of FIG. 2.

Referring to Table 2, the burning rate for guanidinium dinitramide and ammonium nitrate was substantially faster than that for nitroguanidine and ammonium nitrate. Table 2 shows that guanidinium dinitramide requires less ammonium nitrate for complete combustion than nitroguanidine, reducing the effect that ammonium nitrate has on the composition. Nitroguanidine was less sensitive to impact than guanidinium dinitramide, although the value of about 96 kg-cm for guanidinium dinitramide is acceptable. The composition of guanidinium dinitramide and ammonium nitrate had sensitivity values comparable to those for nitroguanidine and ammonium nitrate.

EXAMPLE 2

Figure 3:
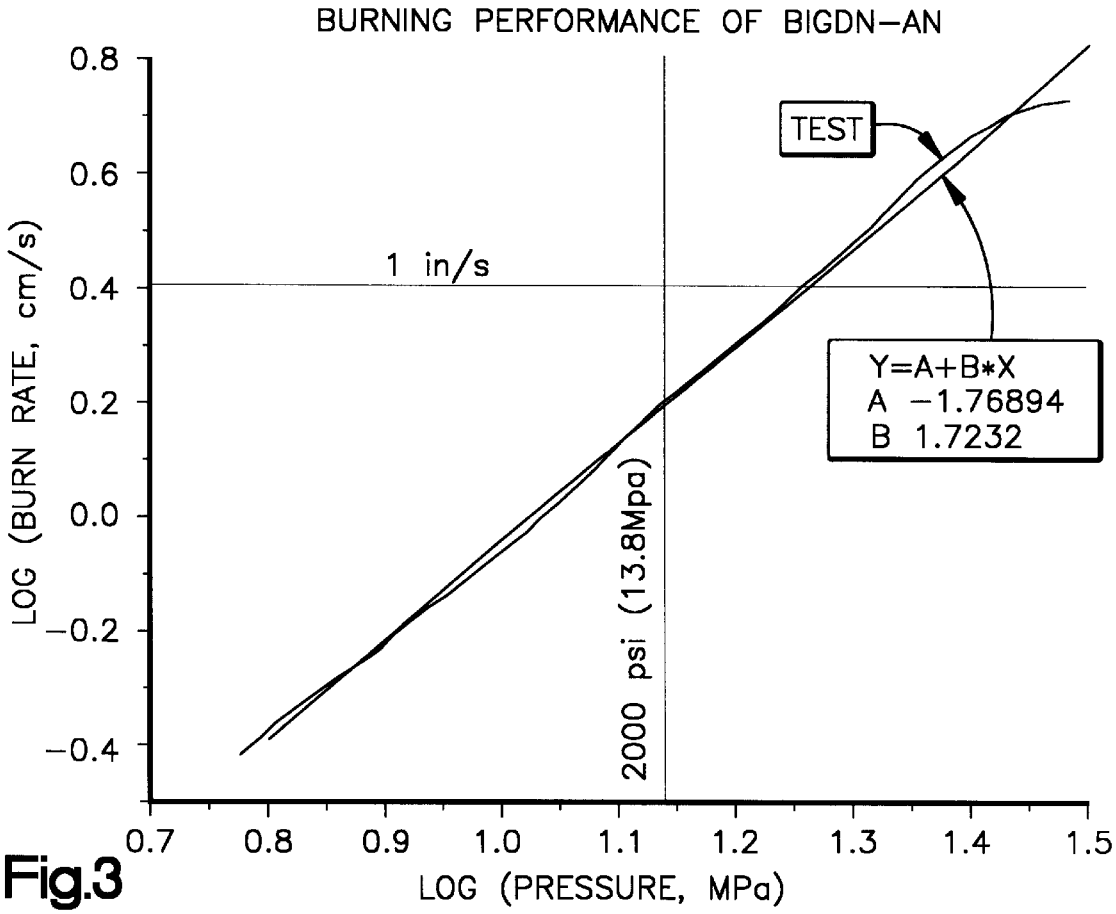
FIG. 3 is a computer generated graph of the burn rate plotted against pressure resulting from the combustion of a body of gas generating material in accordance with another embodiment of the present invention comprising ammonium nitrate (AN) and biguanidinium dinitramide (BiGDN).

A gas generating composition was prepared comprising biguanidinium dinitramide (BiGDN) and reagent grade ammonium nitrate in the weight ratio of 60:40, effective for substantially complete combustion to a gas consisting essentially of carbon dioxide, nitrogen, and water. Biguanidinium dinitramide has the chemical formula $(NH_2(CNHNH_2)_2)^+(N(NO_2)_2)^-$. Biguanidinium dinitramide's melting point is slightly lower than that for guanidinium dinitramide, about 130±5° C. Biguanidinium dinitramide and ammonium nitrate were prepared separately as powders, mixed, tested as a powder mix, screened, compacted into tablets, and further tested as in Example 1. The test results and other data are given in FIG. 3 and the following Table 3.

TABLE 3

| | |
|---|---|
| Fuel wt % | 60 |
| Ammonium Nitrate wt % | 40 |
| Impact, kg-cm, fuel | 204 ± 32 |
| Friction, kPons, fuel | >36 |
| Impact, kg-cm, composition | >300 |
| Friction, kPons, composition | >36 |
| Burning rate, cm/sec at 2000 psi (13.8 Mpa) | 1.56 (0.614 in/sec) |
| Value of A | −1.769 |
| Value of B | 1.732 |

Thermal analysis by DSC revealed that the composition had a broad exotherm at 177° C. indicating the composition melted and decomposed into a gas at a steady rate.

The results for biguanidinium dinitramide were similar to those for guanidinium dinitramide, except that biguanidinium had a burn rate of about 1.56 cm/s at 13.8 MPa, which is significantly faster than that of nitroguanidine but less than that of guanidinium dinitramide. Its burn rate exponent of 1.732 was less than 2.

Furthermore, the close fit of the burn rate results in relation to the calculated straight line indicates that the combustion was steady and free of misfires or irregularities.

EXAMPLES 3–17

Examples 3–17 illustrate additional formulations and combustion results of embodiments of the present invention.

In Examples 3–5, the fuel component is guanidinium dinitramide and the oxidizers are, respectively, potassium nitrate, potassium perchlorate, and ammonium perchlorate. The formulations and combustion results are given in Table 4.

In Examples 6–9, the fuel component is ethylenediaminium bis-dinitramide and the oxidizers are, respectively, ammonium nitrate, potassium nitrate, potassium perchlorate, and ammonium perchlorate. The formulations and combustion results are given in Table 5. Ethylenediaminium bis-dinitramide has the chemical formula $(H_3NCH_2CH_2NH_3)^{2+}(N(NO_2)_2)_2^-$. Its melting point is about 129–130° C.

In Examples 10–13, the fuel component is piperazinediium bis-dinitramide and the oxidizers are, respectively, ammonium nitrate, potassium nitrate, potassium perchlorate, and ammonium perchlorate. The formulations and combustion results are given in Table 6. Piperazinediium bis-dinitramide has the chemical formula $(NH_2CH_2CH_2NH_2CH_2CH_2)^{2+}(N(NO_2)_2)_2^-$. Its melting point is about 212–214° C.

In Examples 14–17, the fuel component is tetramethylammonium dinitramide and the oxidizers are ammonium nitrate, potassium nitrate, potassium perchlorate, and ammonium perchlorate. The formulations and combustion results are given in Table 7. Tetramethylammonium dinitramide has the chemical formula $(N(CH_3)_4)^+(N(NO_2)_2)^-$. Its melting point is about 234–238° C.

All of the formulations in Example 3–17 are based on an oxygen balance of oxidizer to fuel component which produces carbon dioxide as a product, rather than carbon monoxide.

TABLE 4

FORMULATIONS BASED ON GUANIDINIUM DINITRAMIDE FUEL

| | EX 3 | EX 4 | EX 5 |
|---|---|---|---|
| Oxidizer | Potassium Nitrate | Potassium Perchlorate | Ammonium Perchlorate |
| Oxidizer wt % | 19.6 | 17.3 | 22.1 |
| Fuel wt % | 80.4 | 82.7 | 77.9 |
| T flame, K | 2934 | 3123 | 3120 |
| T exhaust, K | 1414 | 1525 | 1495 |
| Gas, mol/100 g | 3.39 | 3.48 | 3.84 |
| Residue, g/100 g | 13.34 | 9.3 | 0 |
| Impetus, lb-ft/lbm | 364,076 | 396,972 | 421,225 |

TABLE 5

FORMULATIONS BASED ON ETHYLENEDIAMINIUM BIS-DINITRAMIDE FUEL

| | EX 6 | EX 7 | EX 8 | EX 9 |
|---|---|---|---|---|
| Oxidizer | Ammonium Nitrate | Potassium Nitrate | Potassium Perchlorate | Ammonium Perchlorate |
| Oxidizer wt % | 22.6 | 12.9 | 11.2 | 14.6 |

TABLE 5-continued

FORMULATIONS BASED ON ETHYLENEDIAMINIUM BIS-DINITRAMIDE FUEL

| | EX 6 | EX 7 | EX 8 | EX 9 |
|---|---|---|---|---|
| Fuel wt % | 77.4 | 87.1 | 88.8 | 85.4 |
| T flame, K | 3134 | 3208 | 3305 | 3292 |
| T exhaust, K | 1562 | 1660 | 1786 | 1750 |
| Gas, mol/100 g | 3.95 | 3.63 | 3.65 | 3.80 |
| Residue, g/100 g | 0 | 8.8 | 5.6 | 0 |
| Impetus, lb-ft/lbm | 433,085 | 412,208 | 408,572 | 446,029 |

TABLE 6

FORMULATIONS BASED ON PIPERAZINEDIIUM BIS-DINITRAMIDE FUEL

| | EX 10 | EX 11 | EX 12 | EX 13 |
|---|---|---|---|---|
| Oxidizer | Ammonium Nitrate | Potassium Nitrate | Potassium Perchlorate | Ammonium Perchlorate |
| Oxidizer wt % | 61.5 | 44.7 | 40.9 | 48.4 |
| Fuel wt % | 38.5 | 55.3 | 59.1 | 51.6 |
| T flame, K | 2744 | 2759 | 3239 | 3195 |
| T exhaust, K | 1216 | 1520 | 1802 | 1676 |
| Gas, mol/100 g | 4.10 | 2.58 | 2.74 | 3.64 |
| Residue, g/100 g | 0 | 30.6 | 22 | 0 |
| Impetus, lb-ft/lbm | 382,299 | 283,977 | 352,361 | 411,843 |

TABLE 7

FORMULATIONS BASED ON TETRAMETHYLAMMONIUM DINITRAMID FUEL

| | EX 14 | EX 15 | EX 16 | EX 17 |
|---|---|---|---|---|
| Oxidizer | Ammonium Nitrate | Potassium Nitrate | Potassium Perchlorate | Ammonium Perchlorate |
| Oxidizer wt % | 81.6 | 69.2 | 65.8 | 56.6 |
| Fuel wt % | 18.4 | 30.8 | 34.2 | 43.4 |
| T flame, K | 2527 | 2370 | 3191 | 3190 |
| T exhaust, K | 1059 | 1521 | 1797 | 1379 |
| Gas, mol/100 g | 4.28 | 2.05 | 2.26 | 4.64 |
| Residue, g/100 g | 0 | 47.3 | 35.4 | 0 |
| Impetus, lb-ft/lbm | 365,033 | 207,490 | 369,800 | 508,022 |

Referring to Table 4, Example 3 contains 19.6 weight % of potassium nitrate and 80.4 weight % of guanidinium dinitramide for substantially complete oxidation of the carbon atoms in guanidinium dinitramide to carbon dioxide. The flame temperature, exhaust temperature, amount of gas produced, amount of residue produced and impetus are all within acceptable performance specifications for gas generating compositions used in vehicle occupant protection devices.

Example 4 contains 17.3 weight % of potassium perchlorate and 82.7 weight % of guanidinium dinitramide for substantially complete oxidation of the carbon atoms in guanidinium dinitramide to carbon dioxide. The flame temperature, exhaust temperature, amount of gas produced, amount of residue produced and impetus are all within acceptable performance specifications for gas generating compositions used in vehicle occupant protection devices.

Example 5 contains 22.1 weight % of ammonium perchlorate and 77.9 weight % of guanidinium dinitramide for substantially complete oxidation of the carbon atoms in guanidinium dinitramide to carbon dioxide. The flame temperature, exhaust temperature, amount of gas produced, amount of residue produced and impetus are all within acceptable performance specifications for gas generating compositions used in vehicle occupant protection devices.

In Examples 3–5, the gas generating compositions produce a gas product which is essentially free of or low in particulates. Furthermore the amount of gas produced in the combustion reaction, and its energy (impetus), are effective for activating a vehicle occupant protection device such as an air bag.

Similar results are obtained in Table 5 (Examples 6–9), Table 6 (Examples 10–13), and Table 7 (Examples 14–17) where ethylenediaminium bis-dinitramide, piperazinediium bis-dinitramide and tetramethylammonium dinitramide are used, respectively, as fuel components.

None of the Examples include a binder component. In actual practice, a gas generating composition useful for a vehicle occupant protection device will preferably comprise a binder to maintain the integrity of a body of the gas generating composition. A binder would be selected which would not materially affect the combustion results shown in the Tables.

Advantages of the present invention should now be apparent. Primarily the present invention takes advantage of the favorable performance characteristics of using a dinitramide salt as the fuel component in a gas generating composition for providing gas for inflating an inflatable vehicle occupant protection device. The dinitramide salt in the present invention has the formula $X^+[N(NO_2)_2]_n^-$, wherein n is one or more and $X^+$ is a cationic derivative of an organic compound having one or more tetravalent nitrogen atoms. A mixture of the oxidizer and the dinitramide fuel offers improved mechanical stability and increased burning rate without sacrificing chemical stability. Furthermore, the gas generating composition of the present invention produces an improved gas product which is essentially non-toxic and free of particulates. In preferred embodiments of the present invention, the improvements in mechanical stability and quality of the gas product accrue from the use of less oxidizer for complete combustion of the fuel component. Except for Examples 14–17, the amount of oxidizer is within the range from about 11% to about 62%.

From the above description of the invention, those skilled in the art will perceive improvements, changes, and modifications. Such improvements, changes and modifications within the skill of the art are intended to be covered by the appended claims.

Having described the invention the following is claimed:

1. An apparatus comprising an inflatable vehicle occupant protection device and a gas generating composition which when ignited produces gas to inflate said inflatable vehicle occupant protection device, said gas generating composition comprising an oxidizer, and a fuel component, wherein said fuel component is a dinitramide salt having the formula $X^+[N(NO_2)_2]_n^-$ wherein n is equal to one or more and $X^+$ is a cationic derivative of an organic compound having one or more tetravalent nitrogen atoms.

2. The apparatus as defined in claim 1 wherein said oxidizer is selected from the group consisting of ammonium nitrate, potassium nitrate, potassium perchlorate, ammonium perchlorate, metal oxides, metal complexes and mixtures thereof.

3. The apparatus as defined in claim 2 wherein the oxidizer is ammonium nitrate and said ammonium nitrate is phase stabilized.

4. The apparatus as defined in claim 1 wherein the dinitramide salt has a melting point of at least 125° C.

5. The apparatus as defined in claim 1 wherein the weight percent of the oxidizer necessary for substantially complete combustion of the dinitramide salt to carbon dioxide, nitrogen, and water is less than 80% based on the combined weight of the dinitramide salt and oxidizer.

6. The apparatus as defined in claim 1 wherein the weight percent of oxidizer based on the combined weight of oxidizer and fuel component is within the range of about 10% to about 60%, and the burn rate is at least about 0.6 inch/sec at 2000 psi (13.8 MPa).

7. The apparatus as defined in claim 1 wherein the gas generating composition comprises from about 2.5 to about 10% binder based on the weight of the gas generating composition.

8. The apparatus as defined in claim 1 wherein said cationic derivative of an organic compound having one or more tetravalent nitrogen atoms is selected from the group consisting of guanidinium, biguanidinium, ethylenediaminium, piperazinediium, tetramethylammonium, monoaminoguanidinium, biaminoguanidinium, triaminoguanidinium, tetrazolium, aminotetrazolium, diamino-furazanium, polyvinylammonium, and dicyandiamidium.

9. An apparatus comprising an inflatable vehicle occupant protection device and a gas generating composition which when ignited produces gas to inflate said inflatable vehicle occupant protection device, said gas generating composition comprising:

a dinitramide salt having the formula $X^+[N(NO_2)_2]_n^-$ wherein n is equal to one or more and $X^+$ is selected from the group consisting of guanidinium, biguanidinium, ethylenediaminium, piperazinediium, tetramethylammonium, monoaminoguanidinium, biaminoguanidinium, triaminoguanidinium, tetrazolium, aminotetrazolium, amino-ammonium-furazan, polyvinylammonium, and dicyandiamidium;

an oxidizer selected from the group consisting of ammonium nitrate, potassium nitrate, potassium perchlorate, ammonium perchlorate, metal oxides, metal complexes and mixtures thereof; and a binder.

10. The apparatus as defined claim 9 wherein said dinitramide salt is guanidinium dinitramide.

11. The apparatus as defined in claim 10 wherein the oxidizer is ammonium nitrate and ammonium nitrate is phase stabilized.

12. The apparatus as defined in claim 11 wherein the binder comprises from about 0 to about 10% based on the weight of the gas generating composition.

13. An apparatus comprising an inflatable vehicle occupant protection device and a gas generating composition which when ignited produces gas to inflate said inflatable vehicle occupant protection device, said gas generating composition comprising an oxidizer, and a fuel component, wherein said fuel component is a dinitramide salt having the formula $X^+[N(NO_2)_2]_n^-$ wherein n is equal to one or more and $X^+$ is a cationic derivative of an organic compound having one or more tetravalent nitrogen atoms;

said dinitramide salt having a melting point of at least 125° C., and the weight percent of the oxidizer necessary for substantially complete combustion of the dinitramide salt to carbon dioxide, nitrogen, and water is less than 80% based on the combined weight of the dinitramide salt and oxidizer.

14. The apparatus as defined in claim 13 wherein said composition comprises about 2.5% to about 10% binder.

15. The apparatus as defined in claim 14 wherein said oxidizer is ammonium nitrate and wherein said dinitramide salt when combined with the oxidizer has a burn rate of at least 0.2 in/sec at 2000 psi (13.8 MPa).

16. The apparatus as defined in claim 15 wherein the weight percent of oxidizer based on the combined weight of the oxidizer and the fuel component is within the range of about 10% to 60%, and the burn rate is at least 0.2 inch/sec at 2000 psi (13.8 MPa).

17. The apparatus as defined in claim 16 wherein said cationic derivative of an organic compound having one or more tetravalent nitrogen atoms is selected from the group consisting of guanidinium, biguanidinium, ethylenediaminium, piperazinediium, tetramethylammonium, monoaminoguanidinium, biaminoguanidinium, triaminoguanidinium, tetrazolium, aminotetrazolium, amino-ammonium-furazan, polyvinylammonium, and dicyandiamidium.

* * * * *